US005875841A

United States Patent [19]

Wright et al.

[11] Patent Number: 5,875,841

[45] Date of Patent: Mar. 2, 1999

[54] OIL WELL BLOW-OUT PREVENTER

[75] Inventors: Andrew Wright, Sherwood Park; Curtis Phillip Ring, Okotoks, both of Canada

[73] Assignee: Alberta Basic Industries, Ltd., Alberta, Canada

[21] Appl. No.: 832,637

[22] Filed: Apr. 4, 1997

[51] Int. Cl.[6] ..... E21B 33/06

[52] U.S. Cl. ..... 166/85.4; 166/78.1; 166/80.1; 166/84.3; 166/95.1; 166/97.1; 251/1.3; 137/614.19

[58] Field of Search ..... 166/85.4, 86.3, 166/78.1, 80.1, 84.3, 95.1, 97.1; 251/1.3; 137/614.19

[56] References Cited

U.S. PATENT DOCUMENTS

| | | | |
|---|---|---|---|
| 711,721 | 10/1902 | Estes | 166/95.1 |
| 1,546,467 | 7/1925 | Bennett | 166/86.3 |
| 1,662,984 | 3/1928 | Scott et al. . | |
| 2,760,749 | 8/1956 | Ratigan | 251/1.3 |
| 4,099,562 | 7/1978 | Matton | 166/84.1 |
| 4,907,650 | 3/1990 | Heinonen | 166/80.1 |
| 4,943,031 | 7/1990 | Van Winkle | 251/1.3 |
| 5,139,090 | 8/1992 | Land | 166/369 |
| 5,203,410 | 4/1993 | Cobb et al. | 166/95.1 |
| 5,383,519 | 1/1995 | Wright | 166/78 |
| 5,429,188 | 7/1995 | Cameron et al. | 166/78.1 |
| 5,746,249 | 5/1998 | Wright et al. | 251/1.3 X |

*Primary Examiner*—George Suchfield
*Attorney, Agent, or Firm*—Merek & Voorhees

[57] ABSTRACT

An oil well blow-out preventer for use on an oil well equipped with a well casing, a wellhead, a production tubing string, and a pump rod receivable within the production tubing string. The blow-out preventer comprises a central housing member that includes a flow passageway and a pump rod passageway and a blow-out preventer contained within the central housing member. The flow passageway is in communication with the production tubing string and provides a mechanism for fluid to be removed from the well while the pump rod passageway provides an opening for entry of the pump rod into the well. The blow-out preventer includes a pair of rams that are adjustable to seal around the pump rod to prevent the accidental loss or spillage of oil or fluid from the well. The device may also include an integrated pump rod passageway sealing device, to prevent the spillage of fluids from the oil well upon the breakage or removal of the pump rod, and an integrated production tubing string rotator.

6 Claims, 5 Drawing Sheets

OIL WELL BLOW-OUT PREVENTER

FIELD OF THE INVENTION

This invention relates to an apparatus for preventing blow-outs in an oil well. The invention also relates in one of its aspects to the sealing of an oil well in the case of breakage or removal of a pump rod, thereby preventing the spillage of oil or fluids from the well. In another aspect the invention relates to a blow-out preventing apparatus in combination with a tubing string rotator.

BACKGROUND OF THE INVENTION

Most production oil wells contain a well casing within which a production tubing string is positioned. The production tubing string serves as both a means to easily insert and remove a pump rod and also provides a conduit for the extraction of oil and fluids from the well. Typically production tubing strings are held within the well casing through the use of a variety of flanges, hangers and other types of devices that tightly seal the well casing allowing fluids to escape or be removed by way of the production tubing string only.

In many cases an oil reserve or pocket is under considerable underground pressure. Once a well has been drilled, the static pressure to which underground oil is subjected often forces oil upwardly through the well. It is therefore important for conservation, safety and environmental reasons to ensure that there are safe and reliable methods of closing off both the well casing and the production tubing string to prevent the unwanted or accidental spillage of oil or other fluids from the well. In the case of the production tubing string, manually actuated valves or similar structures, often referred to as blow-out preventers, have been developed specifically for this purpose. However, such devices tend to be large, difficult or slow to engage and must be fastened separately to the wellhead making them prone to leakage. The prior devices also offer little assistance in instances where a pump rod breaks near its top, or where the rod has been removed from the production tubing string. In cases of pump rod removal or failure, others have proposed a variety of different methods and devices to seal off the well. These include bolting a flange over the top of the production tubing string and the use of large gate valves mounted in the production tubing string. The inherent short comings with these prior art devices include their inability to operate automatically in the event that a pump rod breaks when a technician is not readily available to shut down the well.

Furthermore, devices that have been proposed and used by others have tended to be large and cumbersome and must be bolted or screwed to the production tubing string. The connection of such devices to the production tubing string results in a wellhead of considerable height and weight. Traditionally such wellheads have been referred to as "Christmas trees" due to their size and the fact that there are usually a large number of elements pointing outwardly from various parts of the tubing string and the components mounted thereon. The servicing of oil wells having such "Christmas trees" attached to their production strings tends to be both complex and time consuming. In addition, with the bolting or screwing together of a large number of component parts, leaking at each junction is often a problem. Where a well casing is inclined or slanted, the considerable weight of these additional devices can place a significant degree of torque upon the various connections, sometimes resulting in failures or stress fracturing.

It has also been known to utilize rotators to slowly rotate the production tubing string in a well as a means to more evenly distribute pump rod wear on the internal surface of the tubing string to extend its life. However, heretofore such rotators have added further to the complexity, height and weight of the components mounted on the wellhead. Difficulties with leakage at joints, added height and weight, and increased torque in slanted wells are even more pronounced when such rotators are utilized.

SUMMARY OF THE INVENTION

The invention therefore provides an oil well blow-out preventer which overcomes the shortcomings of these prior art devices through the incorporation of a structure providing a unitary body that includes a blow-out prevention means and that may also contain a sealing means to automatically prevent the flow and spillage of fluids from the oil well should the pump rod break or be removed. The unitary body may also contain an integrated tubing string rotator. The present invention also provides an internal and integrated flow tee in communication with the production tubing string to provide a means to transport fluid from the well.

Accordingly, in one of its aspects the invention provides an oil well blow-out preventer for use on an oil well having a well casing, a wellhead, a production tubing string, and a pump rod receivable within the production tubing string, the device comprising a central housing member for mounting on the wellhead, said central housing member including a flow passageway and a pump rod passageway, said flow passageway being in communication with the production tubing string and providing a means for fluid to be removed from the well, said pump rod passageway providing a means for entry of the pump rod into the well; and blow-out prevention means contained within said central housing member, said blow-out prevention means including a pair of rams that are adjustable to seal around the pump rod to prevent the accidental loss or spillage of oil or fluid from the oil well, said rams being positioned and housed in a pair of bores in said central housing member and in communication with said flow passageway, said rams being adjustable inwardly or outwardly within said bores through the insertion or retraction of a pair of stems into or out of said central housing member, said stems having inner ends attached to said rams and outer ends extending beyond said central housing member; and said rams containing a longitudinal semi-circular channel on their interior surfaces to seal around the pump rod when said rams are fully inserted into said bores.

In a further aspect the invention provides an oil well blow-out preventer for use on an oil well having a well casing, a wellhead, a production tubing string, and a pump rod receivable within the production tubing string, the device comprising: a central housing member for mounting on the wellhead, said central housing member including a flow passageway and a pump rod passageway, said flow passageway being in communication with the production tubing string and providing a means for fluid to be removed from the well, said pump rod passageway providing a means for entry of the pump rod into the well; blow-out prevention means contained within said central housing member; and, a pump rod passageway sealing means contained within said central housing member, said pump rod passageway sealing means preventing the spillage of fluids from the oil well upon the breakage of the pump rod or its removal from said pump rod passageway.

In yet a further aspect the invention provides an oil well blow-out preventer for use on an oil well having a well casing, a wellhead, a production tubing string, and a pump rod receivable within the production tubing string, the device comprising: a central housing member for mounting on the wellhead, said central housing member including a flow passageway and a pump rod passageway, said flow passageway being in communication with the production tubing string and providing a means for fluid to be removed from the well, said pump rod passageway providing a means for entry of the pump rod into the well; blow-out prevention means contained within said central housing member; and, a production tubing string rotator integrated into said central housing member, said production tubing string rotator applying rotational movement to said tubing string within said well casing and providing means to connect said production tubing string to said flow passageway.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENTS

Figure 1:
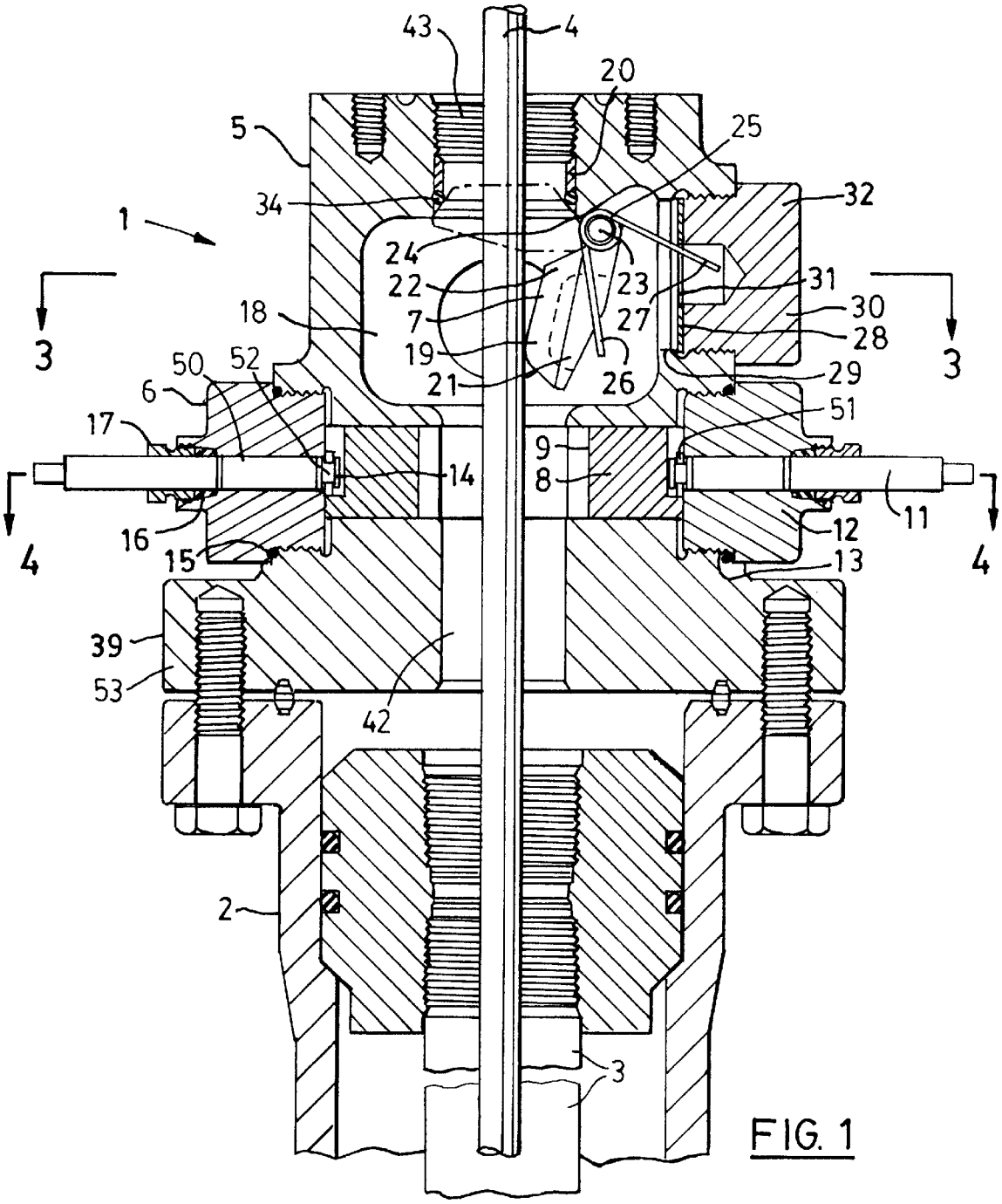
FIG. 1 is a side elevational view in longitudinal section of an oil well blow-out preventer together with an automatic sealing device according to the present invention.

Referring to FIG. 1, the oil well blow-out preventer according to the present invention is noted generally by the reference numeral 1. In a preferred embodiment blow-out preventer 1 is constructed for use on an oil well having a well casing with a wellhead 2 and a production tubing string 3. A pump rod 4 passes through, and is received within, production tubing string 3.

In the embodiment shown in FIG. 1, device 1 is comprised generally of a central housing member 5, a blow-out prevention means 6, a flow passageway 42, a pump rod passageway 43 and a pump rod passageway sealing means 7. As shown, flow passageway 42 is in communication with production tubing string 3 and provides a means for fluid to be removed from the well. Pump rod passageway 43 provides a means to receive and retain pump rod 4 in that portion of the wellhead situated above production tubing string 3.

Figure 4:
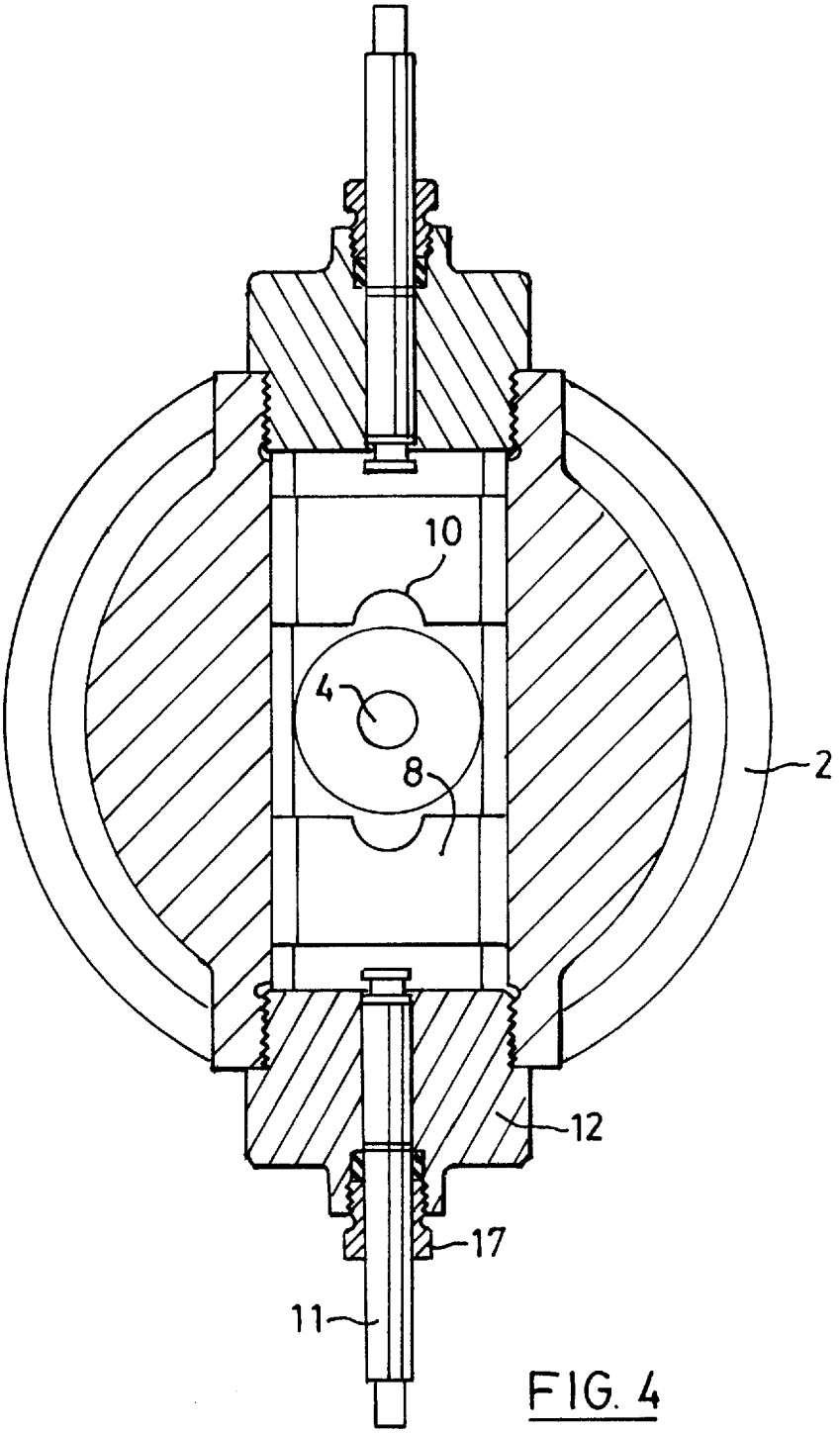
FIG. 4 is a sectional view of the device of FIG. 1 taken along the line 4—4.

Blow-out prevention means 6 preferably comprises a pair of rams 8 that are adjustable to seal around pump rod 4 thereby effectively sealing off flow passageway 42 and pump rod passageway 43 to prevent the accidental loss or spillage of oil or fluid from the well. Typically, rams 8 would be comprised of a rubberized or neoprene block of material that is generally not affected by petroleum products, however, it will be appreciated that a variety of other materials could equally be used. As is more clearly shown in FIG. 4, rams 8 contain a longitudinal semi-circular channel 10 on their internal surfaces 9. When adjusted inwardly, channels 10 encompass pump rod 4 to form a tight seal around the rod.

Figure 3:
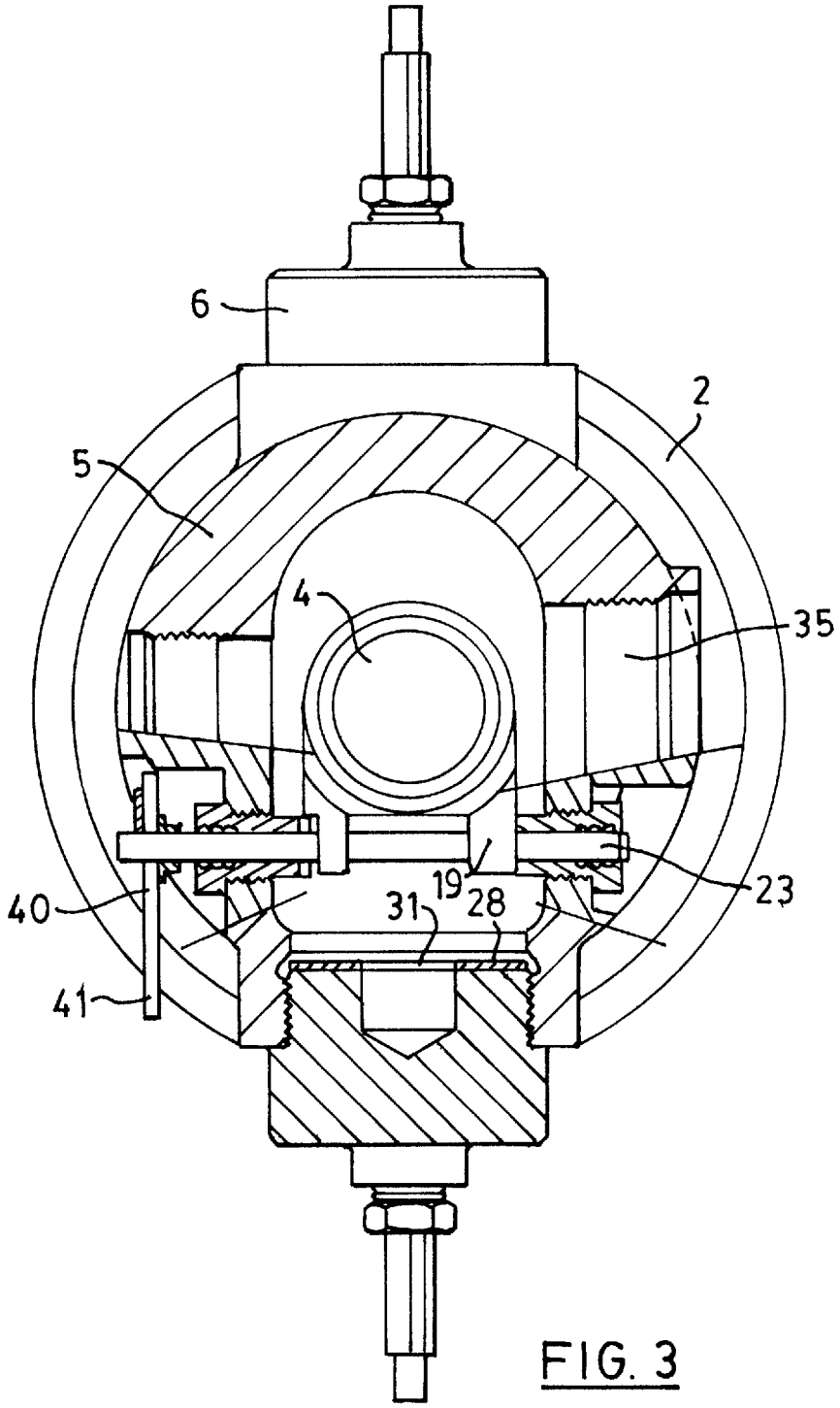
FIG. 3 is a sectional view of the device of FIG. 1 taken along the line 3—3.

Although a variety of different methods could be utilized to adjust or actuate rams 8, in the embodiment shown in FIGS. 1 and 3, rams 8 are adjustable inwardly or outwardly within central housing member 5 through rotating a pair of stems 11. Each stem 11 is threadably received within a bore 50 located in a blow-out prevention plug 12 that is itself threaded into a larger bore 13 within central housing member 5. The inner most ends 14 of stems 11 are attached to rams 8, but are free to rotate relative to the rams. The outermost ends of stems 11 extend beyond the central housing member providing a means to rotate the stems and drive rams 8 either inwardly or outwardly.

Figure 5:
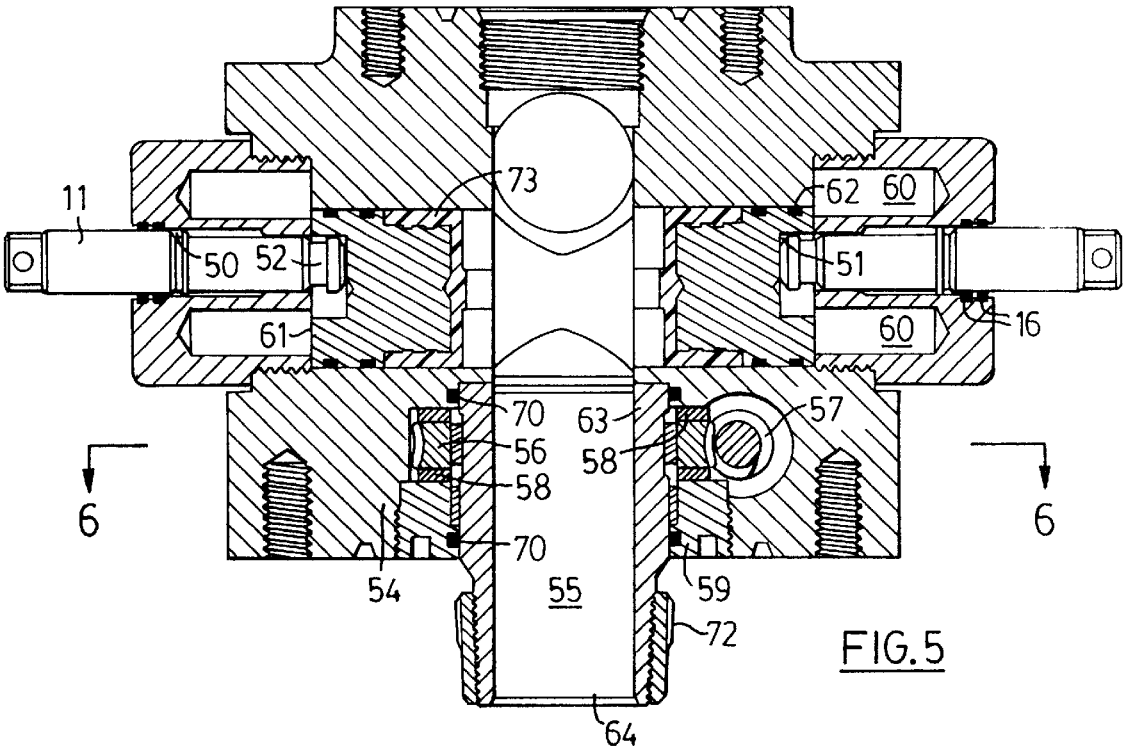
FIG. 5 is a side elevational view in longitudinal section of an alternate embodiment of the present invention; and, FIG. 6 is a sectional view of the device shown in FIG. 5 taken along the line 6—6.

FIG. 5 illustrates an alternate embodiment to that shown in FIGS. 1 and 3 that includes a further structure that may be utilized to adjust or actuate rams 8. In FIG. 5 it will be noted that stems 11 are off-set from the centres of rams 8 and from the longitudinal axes of bores 13. In this embodiment blow-out prevention plugs 12 are threaded into bores 13 within central housing 5 in the same manner as that shown in FIGS. 1 and 3. However, when stems 11 are received within bores 50, the inner most ends 14 of stems 11 contact and are attached to rams 8 at a position above or off the centre of the rams. This is achieved through off-setting bores 50 from the longitudinal axes of bores 13. As in the previously described embodiment, the ends 14 of stems 11 are attached to rams 8 but are free to rotate relative to the rams. Stems 11 can thus be threaded inwardly or outwardly within blow-out prevention plugs 12 in order to actuate the rams.

It will be appreciated that a wide variety of methods and structures could be utilized to attach ends 14 of stems 11 to rams 8. For example, rams 8 could be equipped with channels or slots 51 into which reduced neck areas 52 on the ends of stems 11 may be received in order to secure end 14 to ram 8. That is, ends 14 of stems 11 may be secured to rams 8 through inserting reduced necks 52 into channels or slots 51. In this manner stem 11 will be able to rotate independently of ram 8 while movement of stems 11 into or outwardly from blow-out prevention plugs 12 will cause rams 8 to move inwardly or outwardly within bores 13. Other methods of attaching ends 14 to rams 8 could also be utilized. An important functional feature of this attachment is that rams 8 will move inwardly and outwardly with the movement of stems 11 while stems 11 are able to rotate independently from the rams.

It will also be appreciated that in the embodiment shown in FIG. 5 since stems 11 are off-set relative to the centres of rams 8, any rotational torque that they may impart to the rams will be applied at a point other than at the centres of the rams. This will help to ensure that any such rotational torque applied by the stems to the rams will be applied near the circumference of the rams and will be unlikely to cause rotation of the rams and misalignment of channels 10 with pump rod 4.

The embodiment shown in FIG. 5 also includes sealing means 73 on the inner surfaces of rams 8 to help ensure a tight and effective seal around the pump rod. Preferably sealing means 73 would comprise a rubberized or similar material.

As indicated, when fully adjusted inwardly, rams 8 effectively seal off flow passageway 42 and pump rod passageway 43. When adjusted outwardly, rams 8 are moved free and clear from the flow passageways, offering no resistance to the flow from the well. To prevent leakage of fluids to the environment a seal 15 is placed between blow-out prevention plug 12 and central housing member 5. Typically seal 15 would comprise an O-ring. Seals 62 may also be installed about the circumference of the rams. In addition, as shown in FIG. 1 a stem seal 16 and a stem plug 17 prevent any leakage of fluid from between ram stems 11 and blow-out prevention plug 12. In the alternate embodiment shown in FIG. 5, a pair of stem seals 16 are used on each stem without the addition of a stem plug.

To assist in the movement of rams 8, blow-out prevention plugs 12 may also each include one or more pressure relief chambers 60. In the embodiment shown in FIG. 5 two such chambers are shown within each plug. Pressure relief chambers 60 are in communication with bores 13 such that as the rams are moved outwardly away from the pump rod displaced air will be driven into chambers 60. Since the rams are effectively operating in a sealed system, providing a place for displaced air to be stored will improve the ease by which the rams can be moved. When rams 8 are moved inwardly toward the pump rod, air within pressure relief chambers 60 will fill the void created between the outer faces 61 of rams 8 and the inner surface of the blow-out prevention plugs 12, thereby helping to prevent the establishment of a vacuum in that void and behind the rams. Such a vacuum may tend to pull the rams radially outward and could potentially reduce the effectiveness of the seal between the rams and the pump rod. Preventing the establishment of a vacuum behind the rams will also make movement of the rams radially inward toward the pump rod easier to accomplish.

Referring again to FIG. 1, device 1 may also include pump rod passageway sealing means 7 contained within an internal chamber 18 of central housing member 5. Sealing means 7 includes a rotatable valve member 19 that, in its closed position (shown in ghost outline in FIG. 1), engages a seating member 20 in pump rod passageway 43. Valve member 19 is comprised of a central body 21 having a circumferential seating base 22 for engaging seating member 20. Central body 21 preferably pivots about an axle 23 which is mounted in central housing member 5, generally perpendicular to passageway 43. It will thus be appreciated and understood that through mounting axle 23 generally perpendicular to pump rod passageway 43, pivotal movement of rotatable valve member 19 about axle 23 will allow circumferential seating base 22 to engage seating member 20 and thereby effectively seal off pump rod passageway 43.

Pump rod passageway sealing means 7 also includes biasing means 24 that urges rotatable valve member 19 into a position where circumferential seating base 22 bears against seating member 20. In a preferred embodiment, and as shown in FIG. 1, biasing means 24 comprises a spring 25. Spring 25 is positioned around axle 23 and has a pair of radially extending spring arms 26 and 27. Spring arm 26 is received within central body 21 of rotatable valve member 19, whereas spring arm 27 is held in a tensioned configuration, thereby imparting a biasing force upon rotatable valve member 19 and urging it toward seating member 20.

The amount of force necessary to rotate valve member 19 such that it fully engages seating member 20 and forms an effective seal therewith will vary with the size of pump rod passageway 43. For this reason spring arm 27 is preferably biased against a removable plate 28 that is received within a bore 29 extending through the side of central housing member 5. Bore 29 is preferably threaded so that a plug 30 may be screwed into it to retain removable plate 28 in place. It will therefore be appreciated that through the positioning of removable plate 28 along the length of bore 29 the degree of deflection of spring arm 27, and the resulting tensioning of spring 25, can be adjusted. Spring arm 27 can thus be deflected to the necessary degree to ensue that spring 25 is sufficiently tensioned to pivot rotatable valve member 19 so that it may engage seating member 20. In a preferred embodiment, removable plate 28 is equipped with a centralized hole 31 into which the end of spring arm 27 is received. Through the use of plates 28 having different sized holes 31, the amount of deflection of spring arm 27 can be varied as can the biasing force which spring 25 imparts upon rotatable valve member 19. In its simplest configuration, removable plate 28 may be a washer. Removable plate 28 also serves to hold spring arm 27 in place during assembly of device 1.

Bore 29 and plug 30 also serve the additional function of providing an access means 32 that may be utilized during assembly or for service. If it becomes necessary to access rotatable valve member 19, spring 25, or seating member 20 for purposes of maintenance or replacement an operator need only remove plug 30 and removable plate 28 to have complete and open access to the components of pump rod passageway sealing means 7. For example, to perform maintenance on, or replace, rotatable valve member 19 or spring 25 an operator need only adjust rams 8 inwardly such that they seal around pump rod 4, remove plug 30 and perform the necessary maintenance or part replacement. Accessing pump rod passageway sealing means 7 in this manner can be accomplished without the need to remove any additional components of the oil well. Once the maintenance has been completed, plug 30 can be reinserted and rams 8 withdrawn to restore full production with little down time and related costs.

Referring again to FIG. 1, rotatable valve member 19 is shown to be in its normal position when pump rod 4 is received through pump rod passageway 43 and production tubing string 3. Under normal operating conditions, rotatable valve member 19 bears against pump rod 4 such that pump rod 4 holds rotatable valve member 19 in an open position. FIG. 1 also shows that internal chamber 18 is in direct communication with flow passageway 42 such that internal chamber 18 is filled with production oil when the oil well is in operation. Rotatable valve member 19 is therefore surrounded by a bath of oil which will self lubricate its point of contact with pump rod 4. This self lubrication assists in reducing frictional contact between rotatable valve member 19 and pump rod 4 to prevent wear and drag.

In a preferred embodiment of the present invention rotatable valve member 19 is comprised of stainless steel. Forming value member 19 from stainless steel will both allow for the production of a well machined and dimensioned seating base 22 and will provide a hard exterior surface that will be resistant to wear from coming into contact with pump rod 4.

In an alternate embodiment, circumferential seating base 22 of rotatable valve member 19 may be comprised of a rubberized or neoprene material. The rubberized or neoprene material will assist in helping to create an effective seal between base 22 and seating member 20, and will also ensure that any wear that occurs between rotatable valve member 19 and pump rod 4 will occur on valve member 19.

In operation, should pump rod 4 break or be removed from production tubing string 3, the pump rod will no longer obstruct the movement of rotatable valve member 19.

That is, upon the removal or breakage of pump rod 4, spring 25 will cause rotatable valve member 19 to engage seating member 20 and provide a means to automatically seal off pump rod passageway 43 to prevent the spillage of oil or fluid. When rotatable valve member 19 seals off passageway 43 in this fashion, circumferential seating base 22 is partially received within seating member 20 such that it "seats" against the smooth outer lip 33 of seating member 20.

As shown in FIG. 1 seating member 20 is threadably received within central housing member 5 thereby making it easier to produce a high quality, smooth seating surface than would be the case if seating member 20 were an integral part of central housing member 5. In this way seating member 20 can be removed and replaced if it becomes damaged or worn. Seating member 20 may also include a further sealing means 34. Typically sealing means 34 would comprise an 0-ring that provides an additional seal between circumferential seating base 22 and seating member 20. It will be appreciated that where circumferential seating base 22 is comprised of stainless steel, O-ring 34 will help to prevent the leakage of fluid upon removal or breakage of the pump rod. Depending upon the tolerances between seating base 22 and seating member 20, O-ring 34 may in some cases act as the primary seal against leakage. Where circumferential seating base 22 is comprised of a rubberized or neoprene material, due to the flexibility of the rubberized or neoprene material O-ring 34 may not be necessary or may act as a back-up seal rather than a primary seal.

Figure 2:
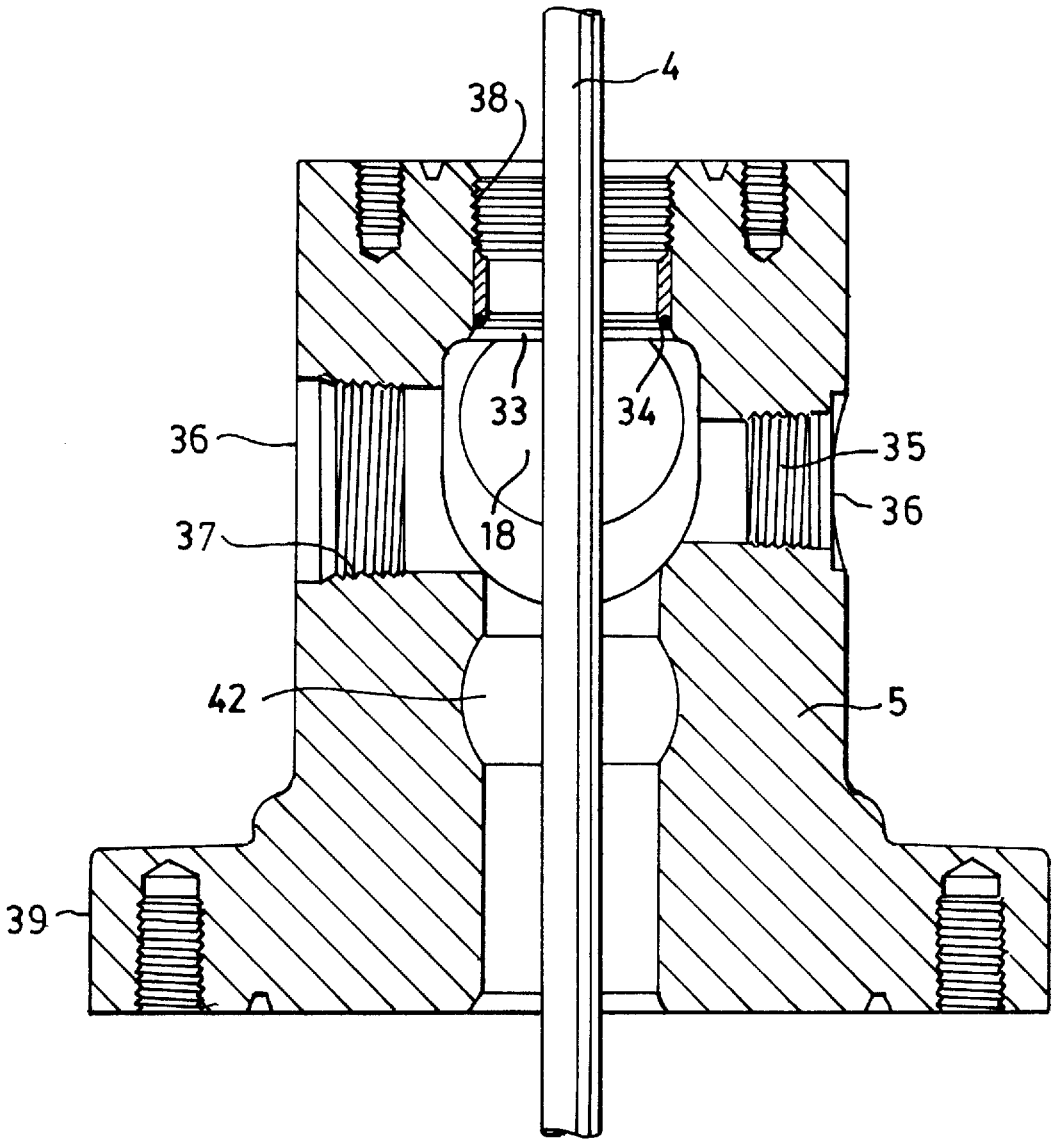
FIG. 2 is a side elevational view in longitudinal section of the device shown in FIG. 1 oriented 90 degrees to the view shown in FIG. 1.

In FIGS. 2 and 3 it will be noted that central housing member 5 includes an internal flow tee 35 that is connected to flow passageway 42 to provide a further means to transport fluid out of the oil well. The opposing ends 36 of flow tee 35 typically contain internal threads 37 such that distribution pipes may be screwed into ends 36 to deliver oil and fluids from the well to central collection tanks or distribution means.

Since producing oil wells are rarely under constant supervision, it is often the case that when a pump rod breaks it goes undetected for a length of time. A broken rod may also be difficult to detect from a distance. For this reason, device 1 may also include an external indication means 40 that identifies the relative position of rotatable valve member 19. In a preferred embodiment, external indication means 40 comprises a pointer or flag 41 fixed to axle 23. In the event that pump rod 4 breaks thereby causing rotatable valve member 19 to engage against seating member 20, pointer or flag 41 will provide a simple and easily recognizable indication means that will advise a technician that the rod has broken and that pump rod passageway sealing means 7 has been automatically activated to prevent the spillage of oil or fluid.

The versatility of device 1 is enhance through being able to configure its lower end 39 to be adaptable to a variety of different wellheads. Depending upon the particular application, lower end 39 may be fitted with a flange 53 to bolt the device to the wellhead (see FIG. 1). Alternatively, and as shown in FIG. 5, lower end 39 may include an integrated production tubing string rotator 54. In this embodiment the production tubing string may be hung either directly from the bottom of the rotator or it may be hung within the well casing through the use of a tubing string hanger (or as it is sometimes referred to in the industry a "dognut"). In the latter instance the lower end of the rotator would typically be received within the dognut through a splined drive connection allowing for rotational movement to be transferred from the rotator to the production tubing string.

Figure 6:
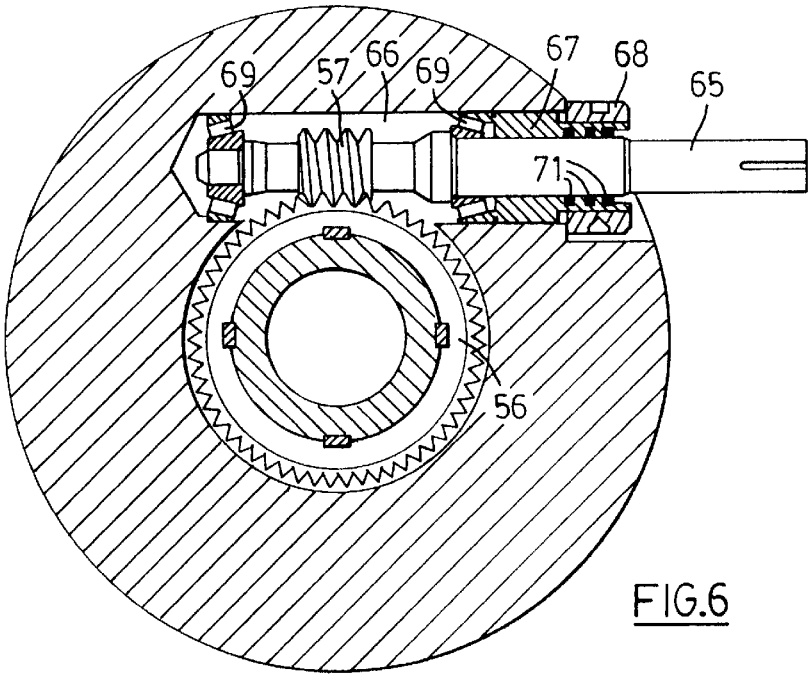

As shown in FIGS. 5 and 6, in a preferred embodiment rotator 54 is comprised generally of a rotator mandrel 55, a bull gear 56, a worm gear 57, bearing means 58 and a retaining plate 59. With the exception of mandrel 55, all of the components of the rotator are housed within the lower portion of central housing member 5, forming an integral part thereof. The upper end 63 of mandrel 55 is received within central housing member 5 while lower end 64 extends below the bottom surface of the central housing member to engage the production tubing string. Lower end 62 may include splines 72 to transfer rotational movement from the mandrel to the production tubing string.

Bull gear 56 is preferably attached to mandrel 55 and meshes with worm gear 57 such that rotation of the worm gear causes the bull gear and the mandrel to also rotate. As shown in FIG. 6, worm gear 57 includes a shaft 65 that extends outwardly from central housing member 5 for connection to a gear box or other drive mechanism. Shaft 65 is positioned within a bore 66 in central housing member 5 and held in place by an adjusting nut 67 and a locking nut 68. Typically a pair of bearings 69 facilitate in the rotation of, and help support, shaft 65.

It will therefore be appreciated that, under the above structure, application of an external rotational force to shaft 65 will cause the production tubing string attached to mandrel 55 to be rotated. Bearing means 58 will provide for reduced frictional rotation of the mandrel. Depending upon the particular application and wellhead configuration, bearing means 58 may be comprised of thrust bearings, radial bearings, tapered roller bearings or a combination of thrust, radial and/or tapered roller bearings. Under some conditions bearing means 58 may also include or comprise low friction bushing, such as bronze or manganese-bronze bushings.

Retaining plate 59 acts as a means to hold and contain mandrel 55, bull gear 56 and bearing means 58 within central housing member 5. Retaining plate 59 is preferably threaded into central housing member 5 such that it holds the internal parts of the rotator together and also provides a means to easily and quickly install the various parts. Retaining plate 59 will also allow easy access and removal of the internal parts of the rotator for replacement or servicing if necessary.

Rotator 54 is constructed as a sealed system to prevent leakage of oil or fluid from the well. For that reason both mandrel seals 70 and worm shaft seals 71 are incorporated into the device. In the preferred embodiment a pair of mandrel seals are utilized with one seal above and one seal below bearing means 58. Similarly, a pair of worm shaft seals are preferably located between the worm shaft 65 and locking nut 68 to prevent leakage from around the shaft.

Through the incorporation of blow-out prevention means 6, pump rod passageway sealing means 7, and flow tee 35 into central housing member 5 (as shown in the embodiment depicted in FIG. 1), the applicant has created a compact mechanism that allows for the prevention of oil well blow-outs, automatic sealing to prevent the spillage of oil upon the breakage or removal of a pump rod, and integral means to deliver oil and fluid from the well to a centralized holding or distribution system. FIG. 5 shows a similar device wherein central housing member 5 contains blow-out prevention means 6 and an integrated production tubing string rotator. It will be readily appreciated that alternate embodiments to those shown in FIGS. 1 and 5 could also be constructed containing only the blow-out prevention means 6 or blow-out prevention means 6 in combination with pump rod passageway sealing means 7 and/or tubing string rotator 54.

Regardless of the embodiment and the particular internal components of central housing member 5 the compact nature of the device results in a reduction in the height of the wellhead, making access to the well and its above ground components easier. Furthermore, a reduction in size over the prior art results in a significant weight reduction allowing for movement of device 1, its placement upon the wellhead, and servicing, to be accomplished more easily and with smaller and less costly lifting equipment. To facilitate in the movement of device 1, a set of internal lifting threads 38 are provided such that a lifting tool or rod can be screwed into threads 38. The lighter and more compact design also reduces torque applied to the wellhead in slanted wells thereby helping to reduce casing failures and stress cracking. It will also be appreciated that through reducing the number of joints and connections there will be a corresponding reduction in the potential for leakage.

It is to be understood that what has been described are the preferred embodiments of the invention and that it is possible to make variations to these embodiments while staying within the broad scope of the invention. Some of these variations have been discussed while others will be readily apparent to those skilled in the art. For example, while valve member 19 has been described as a rotatable value member, it will be appreciated by those skilled in the art that it could also be comprised of a spring actuated slide or gate value member.

I claim:

1. An oil well blow-out preventer for use on an oil well having a well casing, a wellhead, a production tubing string, and a pump rod receivable within the production tubing string, the device comprising:

(i) a central housing member for mounting on the wellhead, said central housing member including a flow passageway and a pump rod passageway, said flow passageway in communication with the production tubing string and providing a means for fluid to be removed from the well, said pump rod passageway providing a means for entry of the pump rod into the well;

(ii) blow-out prevention means contained within said central housing member, said blow-out prevention means including a pair of rams that are adjustable to seal around the pump rod to prevent the accidental loss or spillage of oil or fluid from the oil well; and, (iii) a production tubing string rotator integrated into said central housing member, said production tubing string rotator applying rotational movement to the production tubing string within the well casing and providing a means to connect said production tubing string to said flow passageway.

2. A device as claimed in claim 1 wherein said rams are positioned and housed in a pair of bores in said central housing member and are in communication with said flow passageway, said rams being adjustable inwardly or outwardly within said bores through the insertion or retraction of a pair of stems into or out of said central housing member, said stems having inner ends attached to said rams and outer ends extending beyond said central housing member.

3. A device as claimed in claim 2 including a pump rod passageway sealing means contained within said central housing member, said pump rod passageway sealing means preventing the spillage of fluids from the oil well upon the breakage of the pump rod or its removal from said pump rod passageway.

4. A device as claimed in claim 3 wherein said pump rod passageway sealing means includes a valve member that automatically seals said pump rod passageway, upon the breakage or removal of the pump rod from the well, through the engagement of said valve member with a seating member positioned in said central housing member circumferentially about said pump rod passageway.

5. A device as claimed in claim 4 wherein said production tubing string rotator includes a rotating mandrel, said mandrel including a spline for transference of rotational movement from said mandrel to said production tubing string.

6. A device as claimed in claim 5 wherein said rams contain a longitudinal semicircular channel on their interior surfaces to seal about the pump rod when said rams are fully inserted into said bores.

* * * * *